US006879326B1

(12) United States Patent
Herman

(10) Patent No.: US 6,879,326 B1
(45) Date of Patent: Apr. 12, 2005

(54) APPARATUS AND METHOD FOR HIGHLIGHTING SELECTED PORTIONS OF A DISPLAY SCREEN

(75) Inventor: Stephen Herman, Monsey, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 466 days.

(21) Appl. No.: 09/599,793

(22) Filed: Jun. 22, 2000

(51) Int. Cl.[7] ..... G09G 5/02
(52) U.S. Cl. ..... 345/589; 345/593
(58) Field of Search ..... 345/589, 593, 345/105, 101, 594, 595, 802, 803

(56) References Cited

U.S. PATENT DOCUMENTS 5,497,454 A * 3/1996 Bates et al. ..... 345/803
5,638,090 A 6/1997 Schnaitter et al.
5,790,084 A 8/1998 Hix et al. ..... 345/7
5,920,313 A 7/1999 Diedrichsen et al. ..... 345/339
5,978,041 A 11/1999 Masuda et al.

FOREIGN PATENT DOCUMENTS

EP 0856829 A2 8/1998
WO WO9921355 4/1999 ..... H04N/5/20

* cited by examiner

*Primary Examiner*—Matthew Luu

(57) ABSTRACT

There is disclosed an apparatus and method for highlighting one or more selected portions of a display screen. The apparatus comprises a color shift controller capable of receiving a user input selecting one of a plurality of portions of a display screen and, in response to the user input selection, modifying the value of the pixels within the selected portion to increase the color temperature of the pixels. The method comprises selecting a portion of the display screen and increasing the color temperature of at least one color within the selected portion of the display screen. In one advantageous embodiment of the present invention, the color shift controller modifies white color pixel values in a selected portion of the display screen to new white color pixel values that have a higher color temperature. The higher color temperatures increase the apparent brightness of the displayed images.

20 Claims, 3 Drawing Sheets

APPARATUS AND METHOD FOR HIGHLIGHTING SELECTED PORTIONS OF A DISPLAY SCREEN

TECHNICAL FIELD OF THE INVENTION

The present invention is directed, in general, to electronic display systems and, more specifically, to an apparatus and method for highlighting selected portions of a display screen.

BACKGROUND OF THE INVENTION

Electronic data processing systems such as personal computers have become increasingly available for general use as costs have decreased and capabilities have increased. Advancements in technology have also resulted in portable laptop computer systems having decreased size, weight, and cost and having increased capabilities. The size and weight of laptop computers significantly decreased when designers of laptop computer monitor displays were able to take advantage of advancements in liquid crystal display (LCD) technologies.

Graphic user interface (GUI) software allows data to be displayed on the screen, of a display unit (such as a computer monitor) in one or more portions of the screen. These portions of the screen, usually rectangular in shape, are referred to as windows. Two or more windows on a computer monitor screen may or may not overlap. When multiple windows are present on a computer monitor screen, it is desirable to be able to highlight one or more of the windows to cause the selected highlighted windows to be seen more easily than the other windows that are not selected.

It is desirable to be able to highlight a window that is displaying a program of television entertainment or a motion picture while other non-highlighted windows simultaneously display other data. It is desirable to highlight the window with an entertainment program so that the viewer is less distracted by other images that may be simultaneously displayed in the other non-highlighted windows.

Methods for highlighting a portion of a display screen (such as a window) in a standard cathode ray tube (CRT) television monitor are well known in the art. One method involves highlighting the selected portion by making it brighter than the other portions of the display screen. This is done by overdriving the beam current in the area of the screen that contains the selected-portion to be highlighted. This provides a level of brightness in the selected portion that is higher than the level of brightness in the other areas.

This method can not be used in LCD displays because 1) the maximum brightness on an LCD screen is limited to the brightness of the backlight times the maximum light transmission of the LCD screen, and 2) the maximum brightness of each window is usually chosen to be the same throughout the LCD screen.

It is known in the television industry that increasing the color temperature of the white portion of a television image makes the television image appear to be brighter than other areas of the same emitted radiant energy of lower color temperature. The National Television Standards Committee (NTSC) standard for television monitors specifies a white color temperature of 6,770° K. Industry practice is to use a white color temperature of 6,500° K for television studio monitors. It is common practice, however, to raise the white color temperature in order to make the screen appear brighter. The white color temperature in cathode ray tube (CRT) television monitors is often set to be equal to a relatively high color temperature between 8,000° K and 15,000° K. This makes the white color in the resulting image appear to be brighter without increasing the luminance of the image.

There is a need in the art for an improved system and method for highlighting a selected portion of a display screen of a display unit. In particular, there is a need for an improved system and method for causing a selected portion of a display screen to appear brighter than other areas of the display screen.

SUMMARY OF THE INVENTION

The present invention provides an improved apparatus and method for highlighting selected portions of a display screen of a processing system. The present invention highlights a selected portion by increasing the color temperature of the colors within the image in the selected portion while leaving unselected portions with an unchanged lower level of color temperature. The higher color temperature increases the apparent brightness of the displayed images. The present invention can simultaneously highlight one or more selected portions of the display screen.

An advantageous embodiment of the present invention comprises a color shift controller that modifies the white color pixel values of a selected portion of the display screen to new white color pixel values that have a higher color temperature.

An alternate advantageous embodiment of the present invention comprises a color shift controller that modifies the input red-blue-green (RGB) pixel values of a selected portion of the display screen to new red-blue-green (RGB) pixel values that have a higher color temperature.

It is a primary object of the present invention to provide an apparatus and method for highlighting a selected portion of a display screen.

It is also an object of the present invention to provide a color shift controller for modifying values of pixels within a selected portion of a display screen to increase the color temperature of the pixels and thereby increase the apparent brightness of the display screen.

It is another object of the present invention to provide a color shift controller for modifying the white values of pixels within a selected portion of a display screen to increase the color temperature of the white pixels and thereby increase the apparent brightness of the display screen.

It is a further object of the present invention to provide a color shift controller for modifying the red-blue-green (RBG) values of pixels within a selected portion of a display screen to increase the color temperature of the resulting color pixels and thereby increase the apparent brightness of the display screen.

It is another object of the present invention to provide an apparatus and method for highlighting a selected portion of a cathode ray tube (CRT) display screen.

It is another object of the present invention to provide an apparatus and method for highlighting a selected portion of a liquid crystal display screen.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out: the same purposes of the present invention. Those skilled in the art should also realize that such equivalent constructions do not depart from the spirit and scope of the invention in its broadest form.

Before undertaking the DETAILED DESCRIPTION, it may be advantageous to set forth definitions of certain words and phrases used throughout this patent document: the terms "include" and "comprise" and derivatives thereof mean inclusion without limitation; the term "or" is inclusive, meaning and/or; the phrases "associated with" and "associated therewith" and derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some-combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

Figure 1:
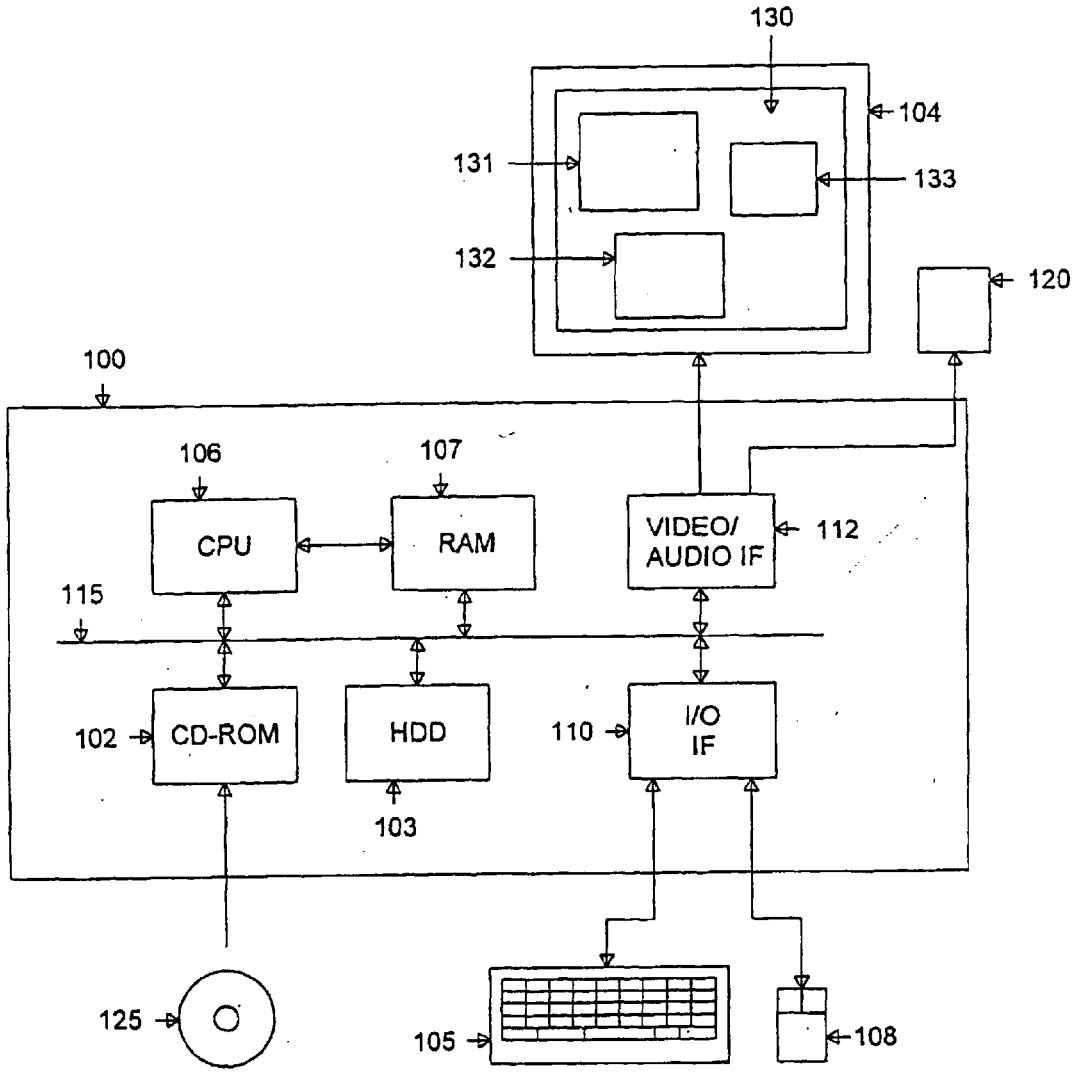
FIG. 1 illustrates a block diagram of an exemplary processing system according to an advantageous embodiment of the present invention.
Figure 2:
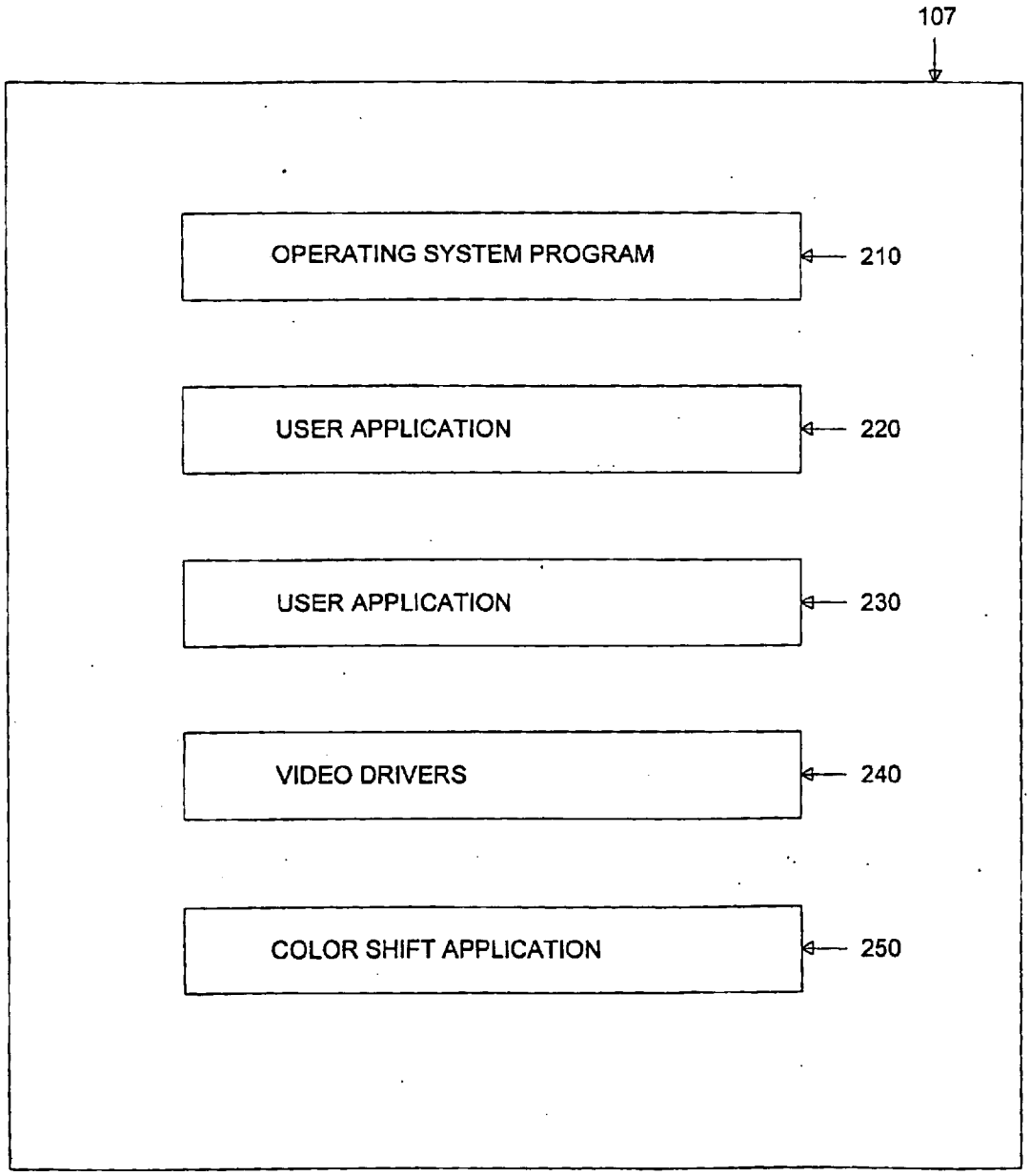
FIG. 2 illustrates computer software that may be used within the exemplary processing system according to an advantageous embodiment of the present invention.
Figure 3:
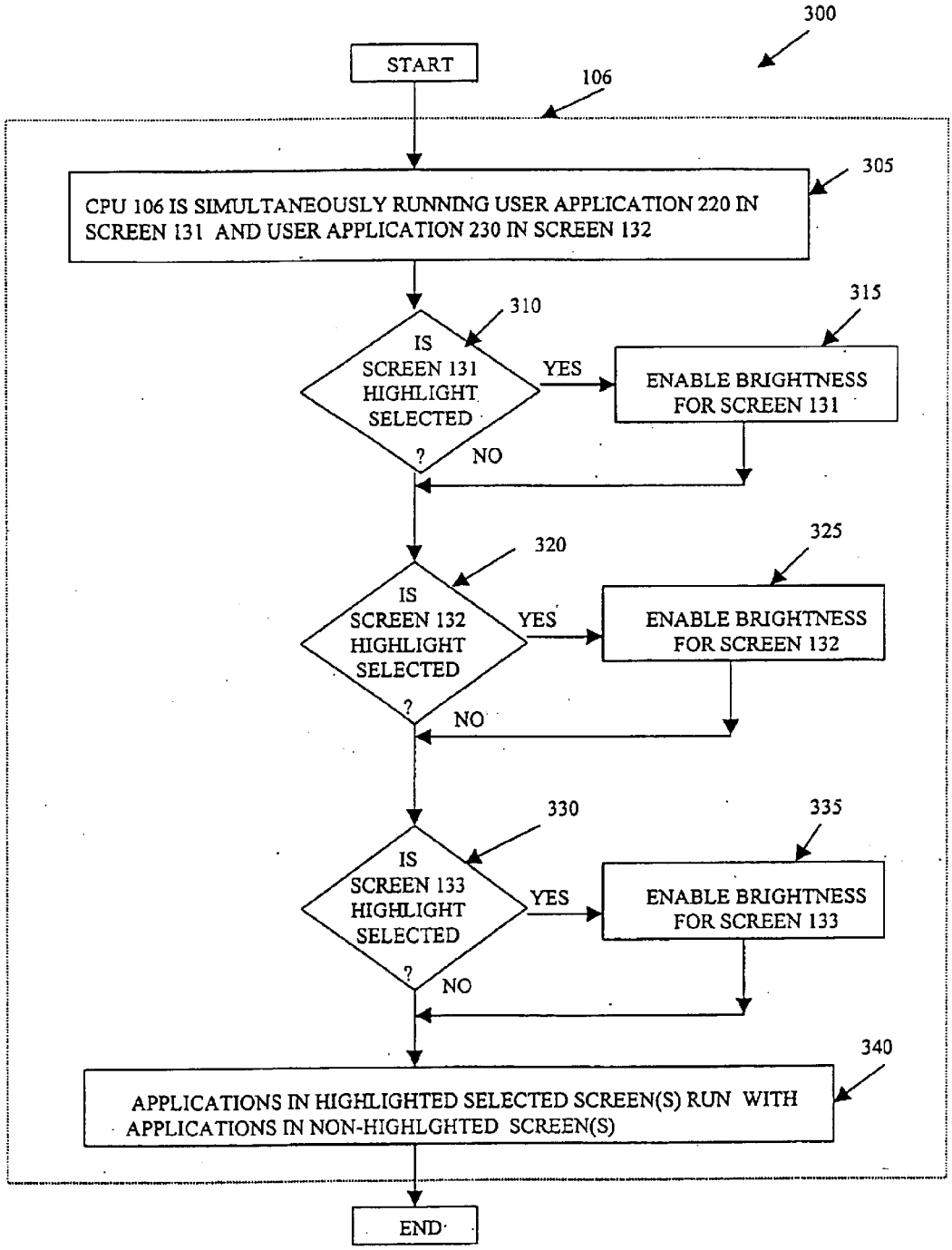
FIG. 3 is a flow chart illustrating a method of selecting one or more portions of a display screen for increasing the apparent brightness of the selected portions according to an advantageous embodiment of the present invention.

FIGS. 1 through 3, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged video display system and display screen.

FIG. 1 illustrates a block diagram of an exemplary processing system. The present invention will be described for an exemplary processing system such as a personal computer. It is to be borne in mind that other types of processing systems may be used to practice the present invention and that the present invention is not limited to use in a personal computer. As will be more fully described, an advantageous embodiment of personal computer 100 comprises software to increase the color temperature of colors within the images in selected portions of the display screen to simulate higher levels of image brightness.

Personal computer 100 comprises a compact disk (CD) read-only-memory (ROM) disk drive 102, hard disk drive (HDD) 103, display monitor 104, keyboard 105, central processing unit (CPU) 106, random access memory (RAM) 107, a pointing device (e.g., a mouse) 108, input/output (I/O) interface (IF) circuit 110, video/audio interface (IF) circuit 112, and audio device (e.g., speaker) 120. CD-ROM disk drive 102 is capable of receiving and reading removable CD-ROM disk 125.

Display monitor 104 serves as the computer monitor for personal computer 100. Display monitor 104 may be either a cathode ray tube (CRT) screen, or a liquid crystal display (LCD) screen, or a flat panel display, screen, or a plasma display screen, or a projection display screen, or any other device suitable for displaying images. Display monitor 104 comprises screen 130, which may display several different images in window 131, window 132, and window 133. Although windows 131, 132 and 133 are shown as not overlapping, it is well known that two or more of them may at least partially overlap each other.

Hard disk drive 105 provides fast access for storage and retrieval of the operating system program, application programs, and data. Keyboard 105 and pointing device 108 are coupled to personal computer 100 through I/O IF circuit 110. Display monitor 104 and speaker 120 are coupled to personal computer 100 through video/audio IF circuit 112. The internal components of personal computer 100, including CD-ROM disk drive 102, hard disk drive 103, CPU 106, RAM 107, I/O IF circuit 110 and video/audio IF circuit 112, are coupled to each other and communicate with each other through computer bus 115.

FIG. 2 illustrates selected portions of RAM 107 within personal computer 100 according to one embodiment of the present invention. RAM 107 stores operating system program 210, video drivers 240, and application software. The application software comprises user application 220, user application 230, and color shift application 250. Computer software 200 may also comprise other application software (not shown). Operating system program 210 and the application software are loaded onto hard disk drive 103 from one or more CD-ROM disks 125. Hard disk drive 103 provides non-volatile storage for the loaded software until one or more of the software programs are deleted from hard disk drive 103.

Video drivers 240 operate in conjunction with color shift application 2;50 to control the apparent brightness in screen 130. Video drivers 240 work in concert with operating system program 210 to control and monitor the operation of display monitor 104 through video/audio IF circuit 112, according to methods well known in the art.

CPU 106 and color shift application 250 together comprise a color shift controller that is capable of carrying out the present invention. Color shift application 250 enables an application program, such as user application program 220 or user application program 230, to highlight a window selected from the group of windows 131–133. When highlighted, a selected window appears brighter in comparison to the unselected screens of the group of windows 131–133 and the background brightness of screen 130.

For example, assume that window 131 is selected to be highlighted. The user selects window 131 through keyboard 105 or pointing device 108 and CPU 106 sends notification of the selection of window 131 to video drivers 240. Video drivers 240 then launch color shift application 250. When active, color shift application 250 modifies the input red-blue-green (RGB) pixel values of window 131 to new red-blue-green (RGB) pixel values that have a higher color temperature. The new RGB pixel values with a higher color temperature cause the image on window 131 to appear brighter than the images on unselected windows 132 and 133 (and brighter than the background in screen 130). Color shift application 250 maintains the higher color levels for window 131 until the user selects another window or terminates the user application controlling window 131.

In one embodiment, color shift application 250 increases the color temperature of white-pixels by using a linear matrix in software to transform the original red-green-blue (RGB) values to new red-green-blue (RGB) values that have a higher color temperature.

In one embodiment, color shift application 250 may be capable of highlighting more than one screen simultaneously. By sending appropriate selection commands, the user can selectively turn on highlighting or turn off highlighting in any or all of the windows 131–133 within screen 130.

FIG. 3 depicts flow chart 300 illustrating the operation of personal computer 100 according to one embodiment of the present invention. The process steps set forth in flow chart 300 are executed in CPU 106. In the first process step 305, CPU 106 is simultaneously running user application 220 in window 131 and user application 230 in window 132. In decision step 310, CPU 106 determines whether window 131 has been selected to be highlighted. If window 131 has not been selected to be highlighted, control then goes to decision step 320. If window 131 has been selected to be highlighted, CPU 106 enables color shift application 250 to increase the color temperatures in window 131 (process step 315). Control then returns to decision step 320.

In decision step 320, CPU 106 determines whether window 132 has been selected to be highlighted. If window 132 has not been selected to be highlighted, control then goes to decision step 330. If window 132 has been selected to be highlighted, then CPU 106 enables color shift application 250 to increase the color temperatures in window 132 (process step 325). Control then returns to decision step 330.

In decision step 330, CPU 106 determines whether window 133 has been selected to be highlighted. If window 133 has not been selected to be highlighted, control then goes to step 340. If window 133 has been selected to be highlighted, CPU 106 enables color shift application 250 to increase the color temperatures in window 133 (process step 335). Control then returns to step 340.

In step 340, the applications in the highlighted screen (or screens) continue to run with the applications that are in other non-highlighted screens.

Although the present invention has been described in detail, those skilled in the art should understand that they can make various changes, substitutions and alterations herein without departing from the spirit and scope of the invention in its broadest form.

What is claimed is:

1. For use in a processing system having a display screen, an apparatus for highlighting a selected portion of said display screen, said apparatus comprising a color shift controller capable of receiving a user input selecting one of a plurality of portions of said display screen and, in response to said user input selection, modifying the color temperature of at least one non-white color within said selected portion of said display screen to effect said highlighting.

2. The apparatus as set forth in claim 1 wherein said display screen comprises a cathode ray tube (CRT) screen.

3. The apparatus as set forth in claim 1 wherein said display screen comprises one of a liquid crystal display screen, a flat panel display screen, a plasma display screen, and a projection display screen.

4. The apparatus as set forth in claim 1 wherein said selected portion of said display screen comprises a first window controlled by a first application executed by said processing system and wherein said color shift controller is capable of modifying red-blue-green (RGB) values of a plurality of pixels in said first window to thereby increase a color temperature of said plurality of pixels.

5. The apparatus as set forth in claim 1 wherein said selected portion of said display screen comprises a first window controlled by a first application executed by said processing system and wherein said color shift controller is capable of modifying a first set of white pixel values in said first window to increase the color temperature of said white pixel values.

6. The apparatus as set forth in claim 5 wherein said color shift controller increases the color temperature of said white pixel values by using a linear matrix in software to transform the original red-green-blue (RGB) values to new red-green-blue (RGB) values that have a higher color temperature.

7. The apparatus as set forth in claim 1 wherein said color shift controller increases the color temperature of said at least one non-white color relative to a color temperature of a background of said display screen.

8. A processing system comprising:

a display screen;

a memory;

a data processor; and an apparatus for highlighting a selected portion of said display screen, said apparatus comprising a color shift controller capable of receiving a user input selecting one of a plurality of portions of said display screen and, in response to said user input selection, modifying the color temperature of the at least one non-white color within said selected portion of said display screen to effect said highlighting.

9. The processing system as set forth in claim 8 wherein said display screen comprises a cathode ray tube (CRT) screen.

10. The processing system as set forth in claim 8 wherein said display screen comprises one of a liquid crystal display screen, a flat panel display screen, a plasma display screen, and a projection display screen.

11. The processing system as set forth in claim 8 wherein said selected portion of said display screen comprises a first window controlled by a first application executed by said processing system and wherein said color shift controller is capable of modifying red-blue-green (RGB) values of a plurality of pixels in said first window to thereby increase a color temperature of said plurality of pixels.

12. The processing system as set forth in claim 8 wherein said selected portion of said display screen comprises a first window controlled by a first application executed by said processing system and wherein said color shift controller is capable of modifying a first set of white pixel values in said first window to increase the color temperature of said white pixel values.

13. The processing system as set forth in claim 12 wherein said color shift controller increases the color temperature of said white pixel values by using a linear matrix in software to transform the original red-green-blue (RGB) values to new red-green-blue (RGB) values that have a higher color temperature.

14. The processing system as set forth in claim 8 wherein said color shift controller increases the color temperature of said at least one non-white color relative to a color temperature of a background of said display screen.

15. For use in a processing system having a display screen, a method for highlighting a selected portion of said display screen comprising:

selecting a portion of said display screen; and modifying the color temperature of at least one non-white color within said selected portion of said display screen to effect said highlighting.

16. The method as set forth in claim 15 wherein the step of modifying the color temperature of at least one color within said selected portion of said display screen is effected by modifying red-blue-green (RGB) values of a plurality of pixels within said selected portion of said display screen.

17. The method as set forth in claim 15 wherein the color temperature of said at least one non-white color is modified relative to a color temperature of a background of said display screen.

18. For use in a processing system having a display screen, computer-executable instructions stored on a computer-readable storage medium for highlighting a selected portion of said display screen, the computer-executable instructions comprising the steps of:

receiving a user input for selecting a portion of said display screen; and modifying the color temperature of at least one non-white color within said selected portion of said display screen to effect highlighting of said selected portion.

19. The computer-executable instructions stored on a computer-readable storage medium as set forth in claim 18 wherein the step of modifying the color temperature of at least one non-white color within said selected portion of said display screen is effected by modifying red-blue-green (RGB) values of a plurality of pixels within said selected portion of said display screen to thereby modify a color temperature of said plurality of pixels.

20. The computer-executable instructions stored on a computer readable storage medium as set forth in claim 18 wherein the color temperature of said at least one non-white color is modified relative to a color temperature of a background of said display screen.

* * * * *